US005823037A

United States Patent [19]

Kim et al.

[11] Patent Number: 5,823,037

[45] Date of Patent: Oct. 20, 1998

[54] ELECTRICALLY HEATED METAL STRIP ROLLING MILL

[75] Inventors: Stanislav K. Kim; Eduard I. Anisimov; Sergey A. Kutsenko; Yury N. Petrochenko, all of Zhukovsky; Andrey Y. Sterlin, Fryazevskaya; Valery V. Voznesensky, Zhukovsky, all of Russian Federation; Won-Guk Jee, Kyonggi-do; Hyung-Min Rho, Seoul, both of Rep. of Korea

[73] Assignee: Kyong In Special Metal Co., Ltd., Incheon, Rep. of Korea

[21] Appl. No.: 745,547

[22] Filed: Nov. 12, 1996

[30] Foreign Application Priority Data

May 18, 1996 [KR] Rep. of Korea ..... 16804/1996

[51] Int. Cl.[6] ..... B21B 27/08

[52] U.S. Cl. ..... 72/201; 72/200; 72/248

[58] Field of Search ..... 72/200, 201, 248

[56] References Cited

U.S. PATENT DOCUMENTS

| | | | |
|---|---|---|---|
| 2,085,449 | 6/1937 | Rohn | 72/201 |
| 2,506,681 | 5/1950 | Norlindh | 72/200 |
| 2,980,561 | 4/1961 | Ford | 72/200 |
| 3,988,914 | 11/1976 | Metcalfe et al. . | |
| 4,047,985 | 9/1977 | Greenberger | 72/201 |
| 4,324,122 | 4/1982 | Urban | 72/201 |
| 5,142,896 | 9/1992 | Berger | 72/248 |
| 5,596,899 | 1/1997 | Sendzimir | 72/248 |

FOREIGN PATENT DOCUMENTS

| | | | |
|---|---|---|---|
| 39-14385 | 7/1964 | Japan . | |
| 63-22885 | 5/1988 | Japan . | |
| 183706 | 7/1988 | Japan | 72/200 |
| 03-69602 | 11/1991 | Japan . | |
| 04-61721 | 10/1992 | Japan . | |
| 04-356314 | 12/1992 | Japan . | |
| 06-292905 | 10/1994 | Japan . | |
| 08-010813 | 1/1996 | Japan . | |
| 651879 | 3/1979 | Russian Federation . | |
| 2042443 | 8/1995 | Russian Federation . | |

*Primary Examiner*—Daniel C. Crane
*Attorney, Agent, or Firm*—Pillsbury Madison & Sutro LLP

[57] ABSTRACT

The invention relates to an electrically heated metal strip rolling mill comprising: front and back reels for supporting a metal strip; electric power suppliers; a roll stand having a base, a roll support frame having upper and lower casings being fastened with studs, at least two pairs of supporting rolls rotatably fixed in said support frame, at least one pair of working rolls rotatably fixed in said roll support frame and disposed between the support rolls, and a roll drive mechanism for driving the support rolls; a means for applying electricity directly to the surface of one roll of the pair of working rolls from the electric power suppliers and conducting the electricity to the outside directly from another roll of the pair of working rolls; and a strip cooler disposed after said roll stand for cooling said metal strip.

15 Claims, 8 Drawing Sheets

A - prior art rolling mill with uncooled working rolls.

B - rolling mill of the present invention with cooled working rolls.

N - electrioal power supplied to the roll stand

V - speed of 2mm thick slab rolling

ELECTRICALLY HEATED METAL STRIP ROLLING MILL

BACKGROUND OF THE INVENTION

1. Field of the Invention

The present invention relates to a strip rolling mill which electrically heats and processes metal strips. The electrically heated rolling mill improves the ability to further work metal sheets or strips by heating them using an electric current during a continuous rolling process.

2. Description of Related Art

USSR Inventor's Certificate No. 651879 discloses an electrically heated rolling mill consisting of a base, a roll stand and working rolls used for processing metal strips which includes flattening and the like. In the mill, the working rolls are the final element of an electric-heating system. The mill, however, cannot produce strips with a width greater than 5 mm.

Russian Federation Patent No. 2042443 discloses a rolling mill which consists of a base, front and back reels, an electric power supply unit, a heating device and a roll stand with supporting and working rolls. The strip manufacturing productivity of the mill, however, is no more than 20–30 kgs per hour because the roll stand and the working rolls overheat. The strip receives only 2–3% of the electric power supplied to the roll stand, so that a high temperature environment occurs in the roll stand severely limiting its operation time and productivity. Furthermore, deviation of the strip thickness approaches 10% of the nominal dimension.

SUMMARY OF THE INVENTION

It is an objective of the present invention to provide an electrically heated metal strip rolling mill with enhanced productivity and efficiency without overheating the roll stand.

It is another objective of the invention to provide an electrically heated metal strip rolling mill which precisely controls the electrical energy applied to a metal strip that passes through the rolling mill at a fast speed to the level of electrical energy saturation (i.e., the energy per unit volume required for plastic deformation, about 2–4 kJ/cm$^3$ for steel).

It is a further objective of the invention to provide an electrically heated metal strip rolling mill in which the gap between the working rolls is precisely adjusted and maintained.

In order to achieve these objectives, the rolling mill of the present invention comprises front and back reels for supporting a metal strip; electric power suppliers; a roll stand having a base, a roll support frame having upper and lower casings being fastened with studs at the corners of the casings, at least two pairs of supporting rolls rotatably fixed in the support frame, at least one pair of working rolls rotatably disposed between the support rolls, and a roll drive mechanism for driving the support rolls; a means for applying electricity directly to the surface of one roll of the pair of working rolls from the electric power suppliers and conducting the electricity to the outside directly from another roll of the pair of working rolls; and a strip cooler disposed after the roll stand for cooling the metal strip.

The rolling mill of the invention may further comprise means for adjusting and maintaining the gap between the working rolls. The gap between the working rolls determines the thickness of the metal strip produced from the roll stand.

Each of the two casings of the roll stand has vertical through-holes for fastening studs. The means for adjusting and maintaining the gap comprises screws extending through the through-holes and nuts which mate with the screws. The means for adjusting and maintaining the gap may further comprise spacer means disposed between the upper and lower casings, gear driver means fixed onto or engaged with the screws for rotating the screws. Auxiliary driver means, e.g., a hydraulic cylinder, is fixed onto the gear driver means for inhibiting or allowing the rotation of the screws around the studs.

The means for applying electricity to the working rolls surrounds and contacts the cylindrical surfaces of the working rolls at an axial end thereof. The means for applying electricity to the working rolls comprises two conductors having semi-cylindrical inner surfaces which mate around the surface of the working rolls and are connected to each other by a spring means for maintaining a predetermined contact pressure against the surface of said working rolls.

The rolling mill of the invention may further comprise means for cooling the working rolls. The means include coolant channels formed in the working rolls for allowing coolant, supplied from an external coolant source, to flow therethrough. The means for cooling the working rolls further comprises coolant channels formed in the means for applying electricity and communicating with the coolant channels of the respective working rolls.

The rolling mill of the invention may further comprise an electric preheating device disposed between the front reel and the roll stand for preheating the metal strip to a predetermined level of electrical energy saturation. The electric preheating device may comprise a parallelogrammic frame and at least one pair of conductor rolls supported by the frame, so that electricity is supplied to the conductor rolls from the electric power suppliers. The sides of the parallelogrammic frame are pivotally connected at the intersection points of any two adjacent sides so that the angles between the sides may be adjusted, one of the pair of conductor rolls being rotatably fixed by the upper side of the frame and the other of the pair of conductor rolls being rotatably fixed by the lower side of the frame. Each of the conductor rolls comprises two semi-cylindrical conductor elements being coupled by spring means for maintaining a predetermined contact pressure against each other. Means for cooling the conductor rolls, similar to the means for cooling the working rolls as described above, are provided with the electric preheating device.

The electric power suppliers consist of a first electric power supply means for supplying electric power to the means for applying electricity to the working rolls and a second electric power supply means for supplying electricity to the preheating device.

The strip cooler has a strip entrance and exit means and may consist of one or more baths of coolant to increase the cooling rate of the strip.

Since electric power is supplied directly to the strip preheating device and to the working rolls in the electrically heated metal strip rolling mill of the present invention, the electrical energy applied to the metal strip at the rolling zone is more precisely controlled to reach a level of electrical energy saturation and energy efficiency is greatly enhanced. The gear and hydraulic drivers, and the synchronizer means provide accurate adjustment and maintenance of the roll gap which determines the thickness of the rolled strip.

The features and merits of the present invention can be better understood by means of the detailed description of the invention with reference to a preferred embodiment of the invention depicted in the accompanying drawings.

DETAILED DESCRIPTION OF THE PREFERRED EMBODIMENT

Figure 1:
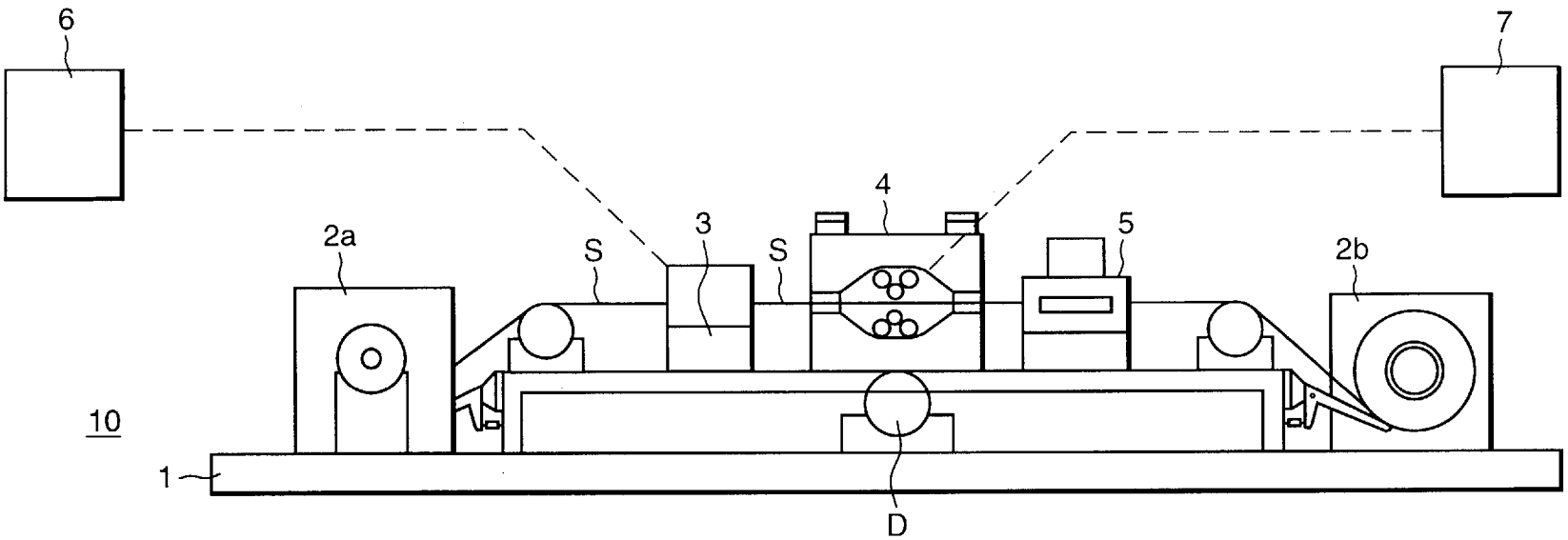
FIG. 1 is a side view of an electrically heated metal strip rolling mill of the present invention.

FIG. 1 is a side view of an embodiment of the electrically heated metal strip rolling mill of the present invention. The rolling mill 10 consists of a base 1, front and rear strip reels 2*a* and 2*b*, electric preheating device 3, a roll stand 4 with a main roll drive D, a strip cooler 5, and electric transformers 6 and 7 which supply electric power to the preheating device 3 and the roll stand 4, respectively. A strip S moves from the front reel 2*a* to the back reel 2*b*, but may also be moved in the reverse direction from the back reel 2*b* to the front reel 2*a*.

Figure 2:
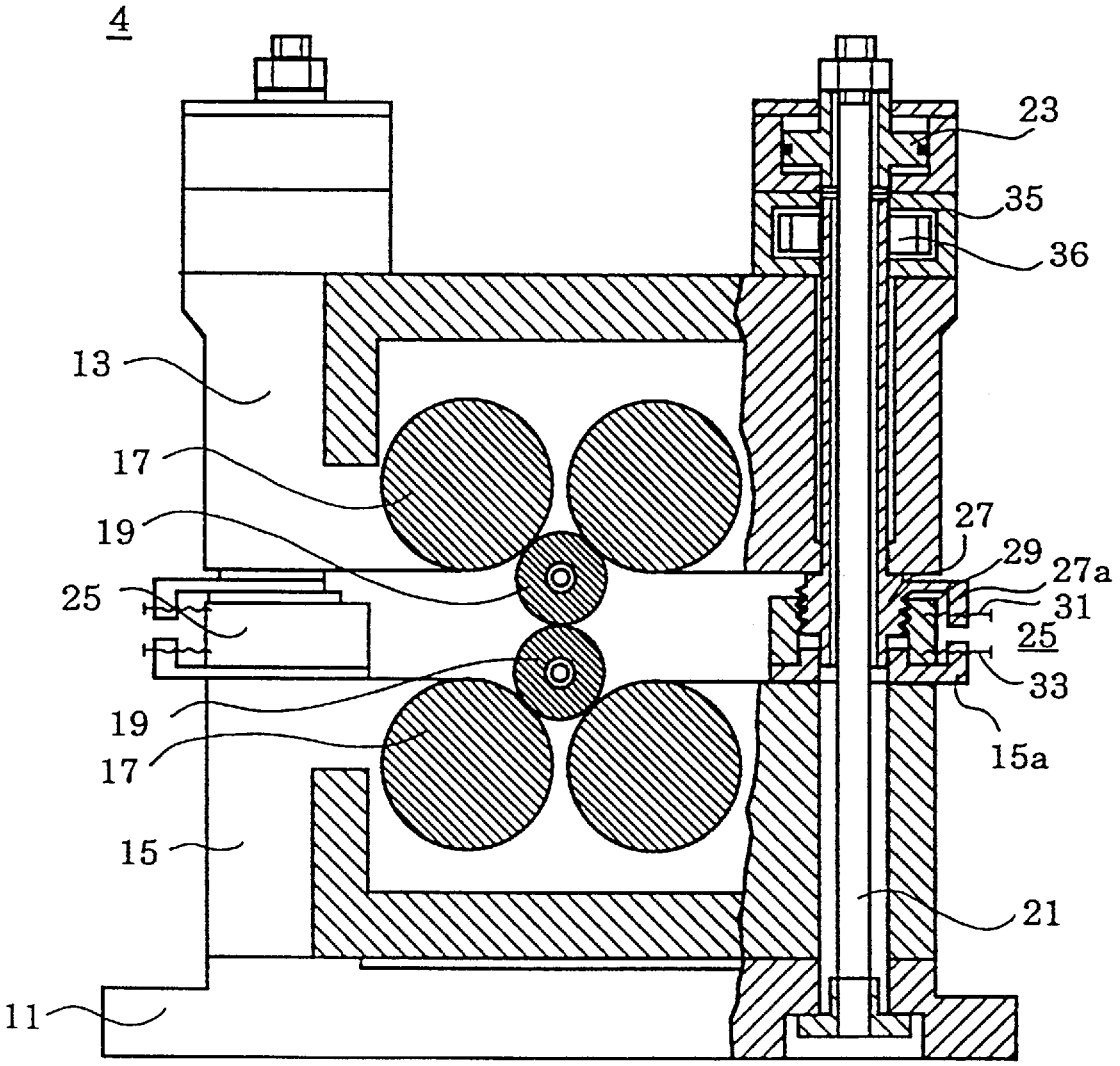
FIG. 2 is a partial sectional side view of the roll stand of the rolling mill of FIG. 1.

The roll stand 4 is shown in FIG. 2 consisting of a base 11, upper and lower casings 13, 15, two pairs of supporting rolls 17, and a pair of working rolls 19. The upper and the lower casings 13, 15 are fastened by studs 21 engaged with a hydraulic cylinder 23 at the upper end thereof.

Adjustable spacers 25 are disposed between the upper and the lower casings 13, 15. The adjustable spacer 25 consists of a screw 27 extending through upper casing 13 and having a hollow portion which receives the stud 21, a nut 29 engaging with the screw 27, an extension 27*a* extending from the screw 27 near the lower end thereof to partly cover the outer surface of the nut 29, and an extension 15*a* extending upward from the upper end of the lower casing 15 to partly cover the outer surface of the nut 29. A pin hole is formed through the extension 27*a* for receiving a pin 31. The pressure or friction force of pin 31 against the surface of the nut 29 prevents the rotation of the screw 27 relative to the nut 29. Another pin hole is formed through the extension 15*a* for receiving a pin 33. The pin 33, inserted into the hole, prevents the rotation of the nut 29.

A gear driver 35 is installed below the hydraulic cylinder 23 and includes a gear 36 engaged with the screw 27. The gear 36 is engaged with the screw 27 by a spline mechanism so that the screw 27 can move in an axial direction to gear 36 while rotationally engaged therewith. The gear 36 is driven by the rotation of a rack gear 37 (See FIG. 3) engaged therewith. As the gear 36 rotates, the screw 27 moves upward or downward according to the direction of rotation of the gear 36. As the lower portion of the screw 27 supports the lower portion of the upper casing 13, the upper casing 13 moves upward or downward when screw 27 is moved up and down, thus, changing the gap between the working rolls 19. The rotation of the screw 27 is prohibited when hydraulic pressure is applied to the hydraulic cylinder 23. In the hydraulic cylinder 23, a single acting cylinder is formed by the space between the piston and lower end of the hydraulic cylinder 23, to which fluid is supplied from an outside source (not shown). This cylinder presses the upper casing downward enough to counteract the pressure which is applied to the working rolls 19 when rolling a strip. If the hydraulic pressure is released from the hydraulic cylinder 23, the screw 27 can be rotated easily.

When the strip S passes through the roll stand 4, the working rolls 19 are rotated by the supporting rolls 17 which are connected with a main roll drive D (see FIG. 1). The main roll drive D comprises a motor (not shown), reduction gears and a universal joint. A rolling pressure is maintained by the supporting rolls 17 and the studs 21. The gap between the working rolls 19 which determine the thickness of the strip S after rolling, is set by the movement of the upper casing 13 which is adjusted by the rotation of screw 27. In order to adjust the gap between the working rolls 19, the hydraulic cylinder 23 are first unloaded. The nut 29 is locked into the lower casing 15 by pin 33 and unlocked from the screw 27 by pin 31, so that the gear driver 35 rotates the screw 27 to obtain a desired roll gap. After the adjustment, the load of the hydraulic cylinder 23 is restored. The force from the hydraulic cylinder 23 is transferred through the stud 21 to the lower casing 15, and closes the force loop on the screw 27 and the nut 29 of the gap adjustment means.

When the front end of the strip S enters the roll stand 4, or when the working rolls 19 are exchanged, the upper casing 13 must be raised. When movement greater than 4 mm is needed, such as when exchanging the rolls, the rack gear 37 should be repeatedly driven over the full length thereof to rotate gear 36. When the rack gear 37 returns to the original position after being driven, the nut 29 is rotatable relative to the lower casing 15 by releasing pin 33 and is rotatable integrally with the screw 27 by inserting pin 31, to maintain the gap between the working rolls 19. By repeating this operation, the gap between the working rolls 19 can be further increased, thus, the upper casing 13 can be raised by an amount necessary to exchange the working roll 19.

Figure 3:
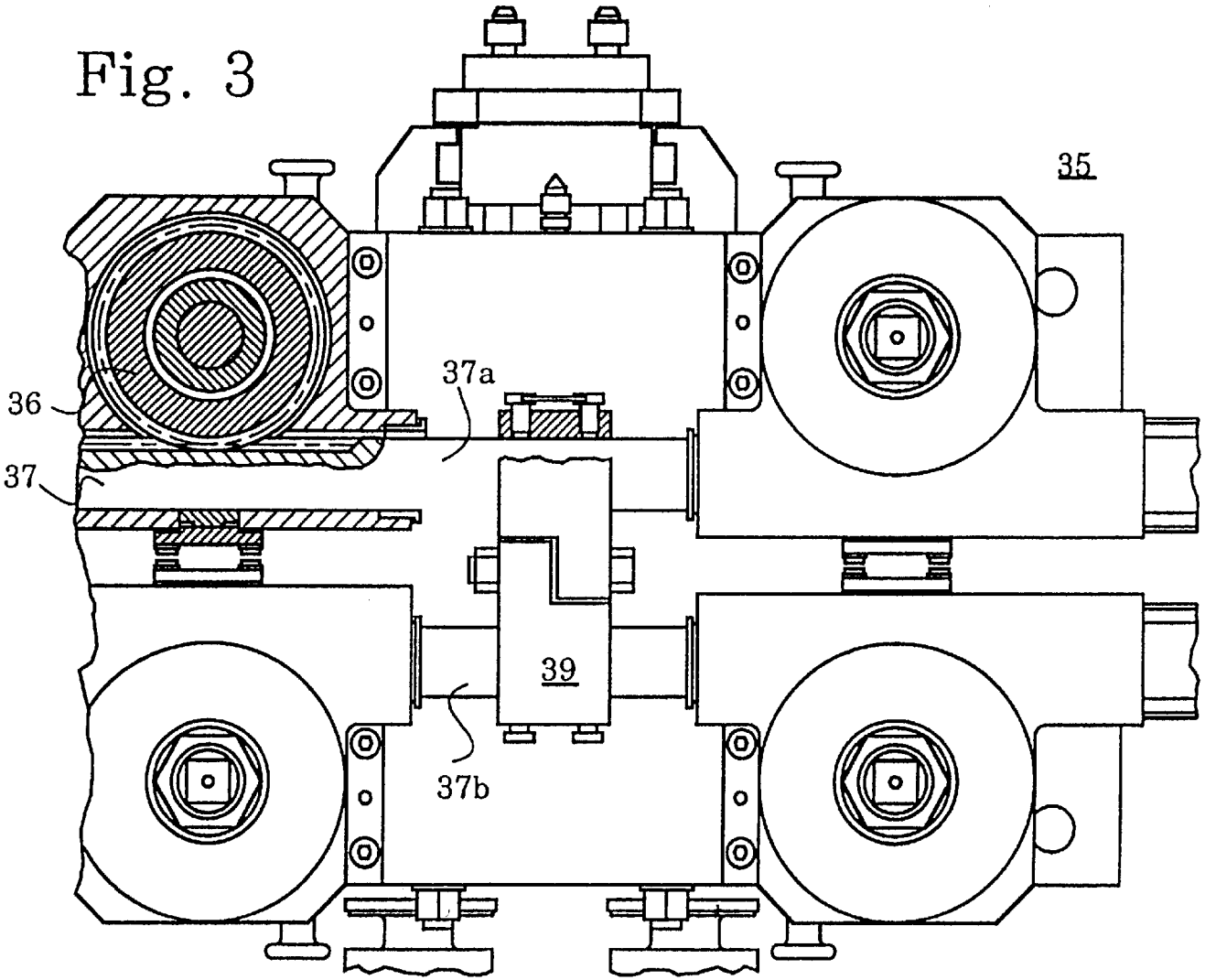
FIG. 3 is a partial sectional plan view of the roll stand of FIG. 2.

FIG. 3 is a plan view of the roll stand 4. The rack gears 37*a*, 37*b* rotating the screw 27 are preferably engaged with the synchronizer 39 to provide uniform rotation of each of the gears 36, to provide a uniform upward or downward movement of the casing 13 due to the rotation of the screws 27. Accordingly, tilting of the working rolls 19 due to the tilting of the casing 13 can be prevented. Any synchronizer 39 may be used as long as it facilitates the uniform rotation of the gear 36. Preferably, a connection rod for directly connecting the pair of rack gears 37*a*, 37*b* can be used as a synchronizer 39.

Figure 4:
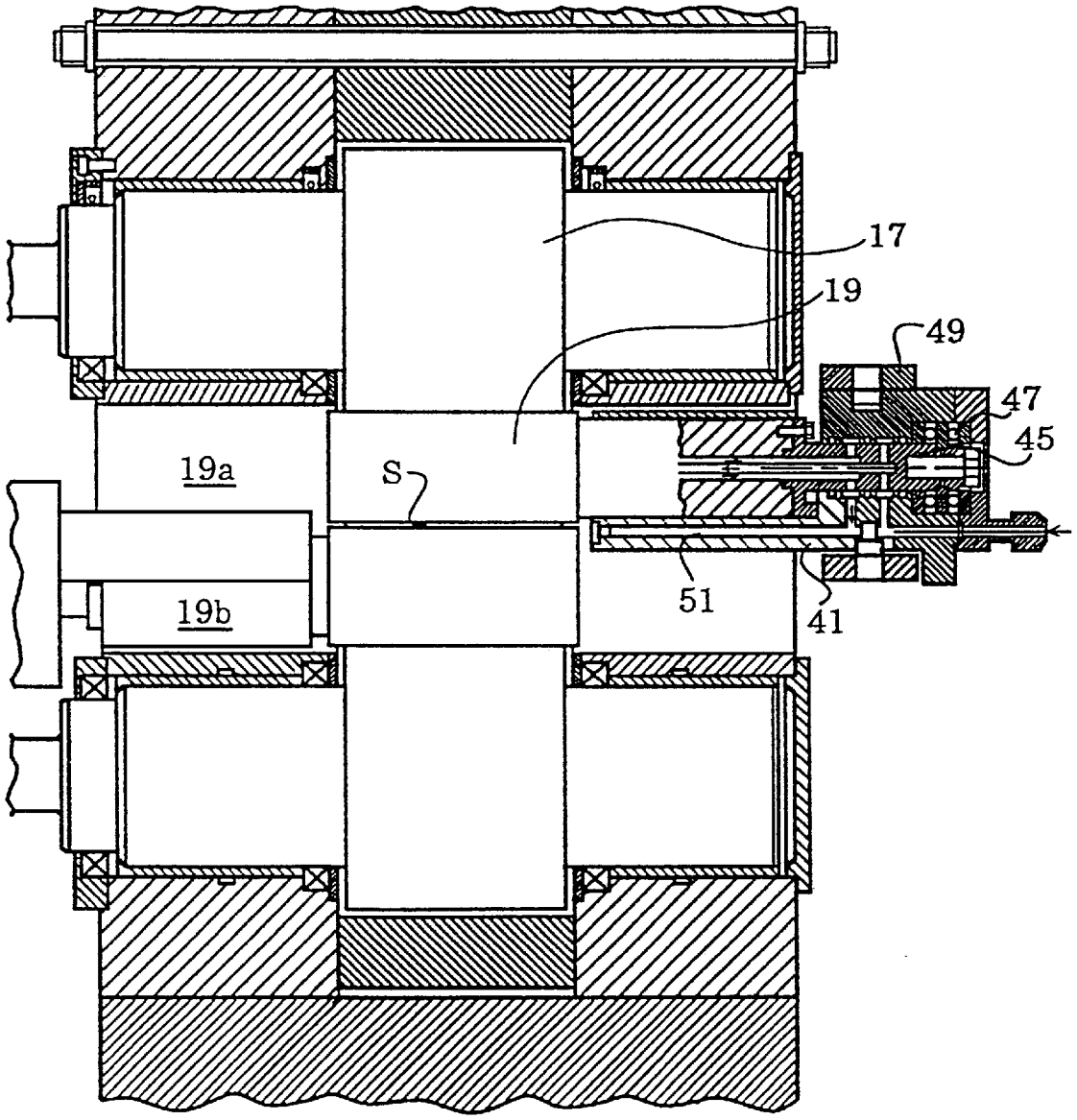
FIG. 4 is a partial sectional front view of the roll stand of FIG. 2.
Figure 5:
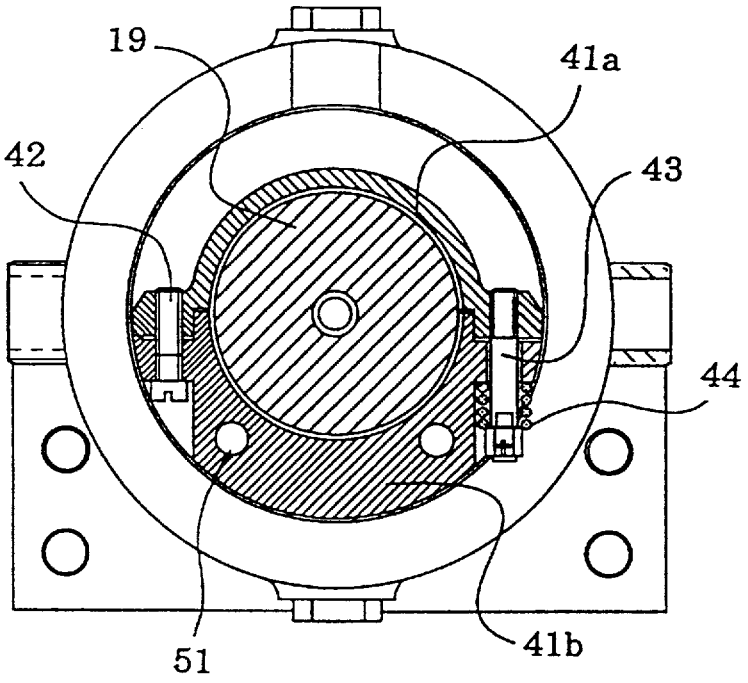
FIG. 5 is a view showing the connection between semi-cylindrical conductors at an axial end of a working roll.

FIG. 4 illustrates the roll stand 4 as seen from the front of the mill 10. The right axial end of the working roll 19 makes contact with an electric conducting unit 41 to which electric power is supplied from the transformer 7. As shown in FIG. 5, the electric conducting unit 41 comprises two semi-cylindrical elements 41*a*, 41*b* coupled by bolts 42, 43 and a spring 44. The spring 44 provides a constant contact pressure between the working roll 19 and the electric conducting unit 41. A lubricant such as graphite may be used between the electric conduction unit 41 and the working roll 19. The working roll 19 is connected with an axial fixture 45, a bearing 47, and means 49 for preventing axial bias and twist in order to support the rotating movement of the working roll 19. Coolant channels 51 are formed in the working roll 19 and the lower element 41*b* of the electric conducting unit 41.

Coolant is supplied from an outer source (not shown) and, after flowing through the channels 51 in the direction indicated by the arrows in FIG. 4 and returns to the source via a heat exchanger (not shown). Thus, the working rolls 19 and the electric conducting units 41 maintain a proper operating temperature which inhibits the degradation of the material properties of the working rolls 19 and the conducting units 41.

Electric current is supplied from the transformer 7 to the upper working roll 19*a* through the electric conducting unit 41. The current passes through the metal strip S and flows to the lower working roll 19*b* and the conducting unit coupled therewith where the current returns to the transformer 7.

Figure 6:
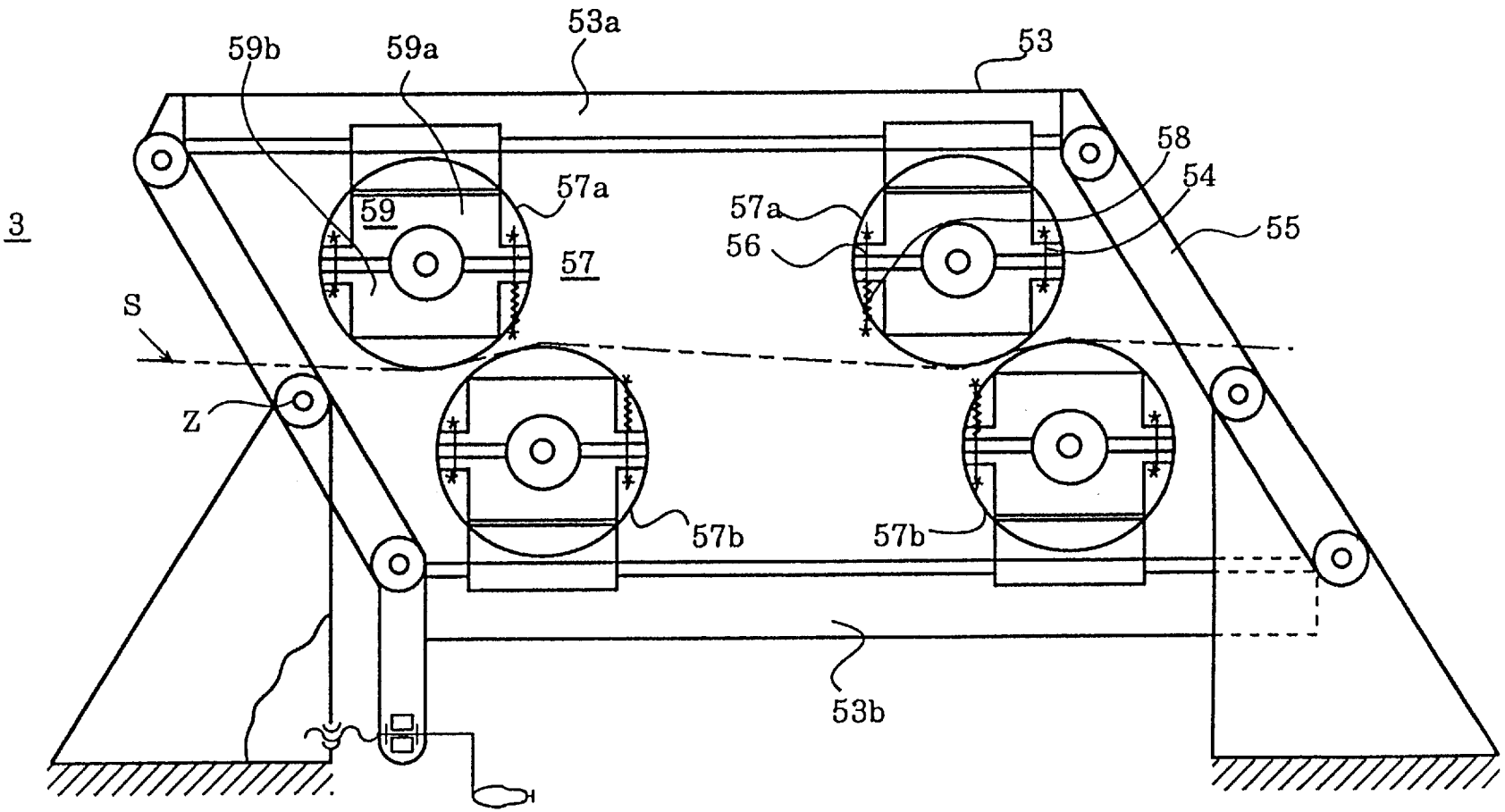
FIG. 6 is a side view of a preheating device.

The preheating device 3 shown in FIG. 6 has a parallelogram structure formed with a pair of parallel horizontal bars 53 and a pair of parallel swinging bars 55. There are two pairs of electric conducting rollers 57 with electric conducting units 59 therein each consisting of two semi-cylindrical elements 59*a* and 59*b*. The elements 59*a* and 59*b* are coupled together by bolts 54, 56 and a spring 58 as shown in the drawing. The upper roller 57*a* of each pair of electric conducting rollers 57 is attached to the upper horizontal bar 53*a*, and the lower roller 57*b* of each pair of electric conducting rollers 57 is attached to the lower horizontal bar 53*b*. Thus, as the swinging bars 55 rotate around the pivot points Z, the area of contact between the electric conducting rollers 57 and the strip S changes. Electric power is supplied from the transformer 6 directly to the front pair of electric conducting rollers 57 and flows onto the strip S and the rear pair of electric conducting rollers 57 where it returns to the transformer 6. Depending on the strip thickness and predetermined current value, it is possible to change the contact area by changing the distance between the pairs of rollers. The angle between the horizontal bars 53 and the swinging bars 55 may be adjusted by using known means such as a screw mechanism.

Figure 7:
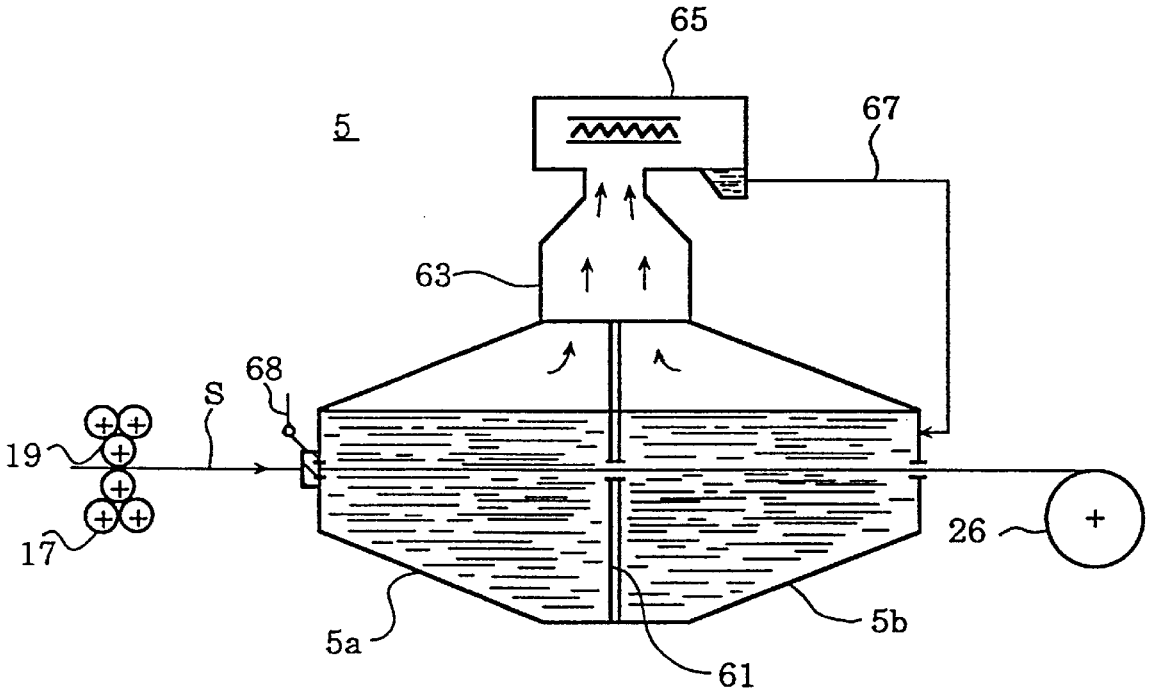
FIG. 7 is a side view of a strip cooler.

The strip cooler 5 is depicted in FIG. 7. The strip cooler 5 consists of sections 5*a* and 5*b* which are placed in the direction of the strip movement and are divided by a partition 61. Both sections 5*a* and 5*b* are filled with coolant and their upper ends are connected with a vapor duct 63. The strip cooler 5 includes a condenser 65 and a channel 67 which returns condensed coolant to section 5*b*. Passages in the wall, which accommodate the input and output of the strip S, are sealed against liquid and vapor. Two elements consisting of heat resistant material such as silicon dioxide which can endure the heat from the heated metal strip and a lever mechanism 68 adjusting the gap between the two elements may be used as a sealing mechanism. A water return means may be further provided to collect and return the cooling fluid leaking out of the sealing portion when the strip passes into and out of the strip cooler 5.

In section 5*a* of the strip cooler 5, the strip S is cooled down, for example, to 100° C. by evaporating coolant from its surface. In section 5*b*, the strip S is cooled down to 50° C. or less. The partition 61 prevents heat transfer from the section 5*a* to the section 5*b*.

Referring to the operation of the rolling mill 10, metal strip S is unwound from the front reel 2*a* and is heated to a predetermined preheating temperature while passing through the preheating device 3. The preheating temperature can be adjusted by varying the electric current supplied from the transformer 6. The strip S is further heated to a rolling temperature in the roll stand 4 by the electric current passing through the strip. Since the strip S is rolled at an elevated temperature, the thickness reduction ratio can be greatly increased. The rolled strip is cooled at a predetermined cooling rate in the strip cooler 5 and then wound onto the rear reel 2*b*. The rolling mill of the invention may be a reversible mill. The reverse rolling process may be a cold process.

As such, the electrically heated rolling mill of the present invention precisely controls the electrical energy in the metal strip S being rolled to reach a predetermined level of energy saturation. Also, since electric power is supplied directly to the conducting unit contacting the working rolls, the efficiency of using electricity is greatly enhanced. The working rolls are continuously cooled by coolant thereby maintaining a proper temperature which greatly enhances the durability of the rolls.

The preheating device of the present invention also provides precise control of the preheating temperature and excellent energy efficiency by direct supply of electric power through the electric conducting rollers.

The gap between the working rolls can be precisely adjusted and maintained by controlling the rotation of the screw by the gear driver, the synchronizer, and the hydraulic cylinder. Accordingly, it is possible to produce metal strips with an accurate thickness.

The preferred embodiment of the present invention represents a rolling mill system with cooled working rolls that weighs less than 10,000 kg. The overall dimensions of the rolling mill may be 9 m×3 m×2.5 m which is considerably less than existing rolling mills for similar purposes. This system requires an electrical capacity of 400 kw with a voltage of 380/220V.

Figure 8:
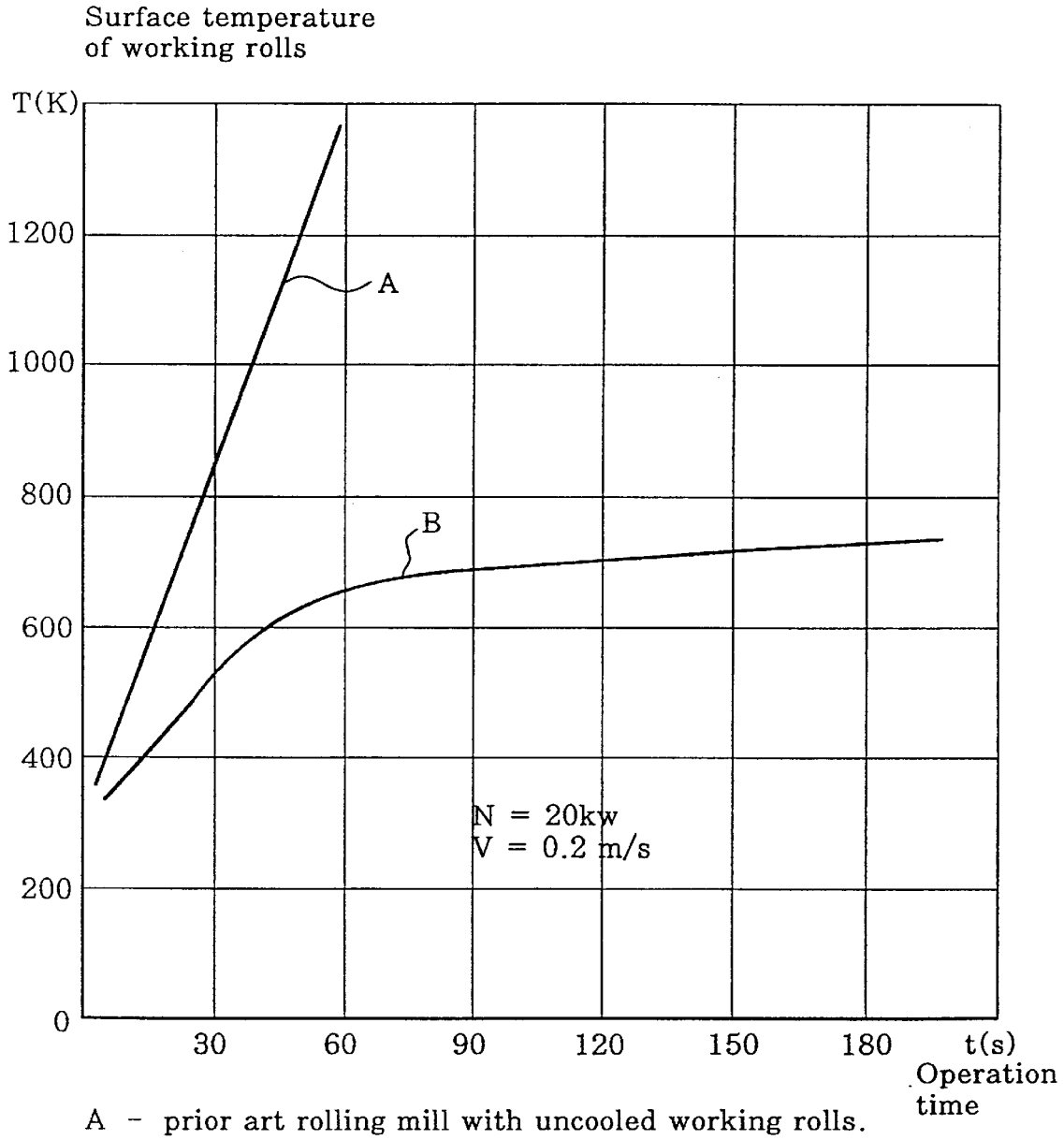
FIG. 8 is a graph showing the temperature of the surfaces of the uncooled working rolls of a prior art rolling mill (line A) and cooled working rolls of the rolling mill of the present invention (line B) relative to operation time based on a numerical analysis.

FIG. 8 shows the temperature of the surfaces of the uncooled working rolls of a prior art rolling mill (line A) and the cooled working rolls of the rolling mill of the present invention (line B) relative to operating time when electric power of 20 kw is supplied to the roll stands and the strips move at a velocity of 0.2 m/sec based on a numerical analysis. The horizontal axis of the graph designates the operating time and the vertical axis designates the temperatures of the surfaces of the working rolls. This graph shows that the temperature of the surfaces of the cooled working rolls of the rolling mill of the present invention (line B) is remarkably reduced and controlled at suitable temperatures while the surfaces of the uncooled working rolls of the prior art rolling mill (line A) overheats. The rolling mill of the present invention can produce about 300 kg of stainless steel strip per hour with a thickness reduction from 2–2.5 mm to 0.1 mm and a width of 100 mm.

The description contained in the specification is illustrative and is not intended to limit the scope or content of the present invention.

The electrically heated rolling mill of the invention may also perform cold rolling in, the reverse direction. The ability to run a combined process results in more productivity and higher strip quality of mechanical properties than produced by known rolling processes. The process described in the present invention may not require the annealing process, which is normally required in cold rolling, and provides greater technical advantages for processing refractory metals and alloys.

We claim:

1. An electrically heated metal strip rolling mill comprising:

a front reel for supporting a metal strip;

electric power suppliers;

a roll stand disposed after said front reel for rolling the metal strip from said front reel, said roll stand having a base, a roll support frame having upper and lower casing being fastened with studs, at least two pairs of supporting rolls rotatably fixed in said support frame, at least one pair of working rolls rotatably fixed in said roll support frame and disposed between the support rolls, and a roll drive mechanism for driving the support rolls;

means for applying electricity directly to a surface of one roll of the pair of working rolls from the electric power suppliers and conducting the electricity to the outside directly from another roll of the pair of working rolls;

means for cooling said working rolls having coolant channels formed therein for allowing coolant, supplied from an external coolant source, to flow therethrough;

a strip cooler disposed after said roll stand for cooling the metal strip from said roll stand; and a back reel disposed after said strip cooler for winding the metal strip from said strip cooler.

2. The rolling mill of claim 1 wherein said means for applying electricity to said working rolls surrounds and contacts cylindrical surfaces of said working rolls at an axial end thereof.

3. The rolling mill of claim 2 wherein the means for applying electricity to said working rolls comprises two conductors having semi-cylindrical inner surfaces which mate around the surface of the working rolls and being connected to each other by a spring means for maintaining a predetermined contact pressure against the surface of said working rolls.

4. The rolling mill of claim 1 wherein the means for cooling said working rolls further comprises coolant channels formed in the means for applying electricity and communicating with the coolant channels of the respective working rolls.

5. The rolling mill of claim 1 further comprising means for adjusting and maintaining a gap between said working rolls which determines thickness of said metal strip.

6. The rolling mill of claim 5 wherein each of the casings of the roll stand has vertical through-holes for the fastening studs, and said means for adjusting and maintaining the gap comprises screws extending through the through-holes, and spacer means having a nut mating with the screw and disposed between the upper and lower casings, gear driver means fixed onto or engaged with the screws for rotating the screws, auxiliary driver means fixed onto said gear driver means for inhibiting or allowing rotation of the screws.

7. The rolling mill of claim 6 wherein the means for adjusting and maintaining the gap further comprise means for synchronizing the rotation of all the screws in the casings.

8. The rolling mill of claim 7 wherein the gear driver means comprises a pinion gear fixed onto each of the studs and a rack gear mating with each of said pinion gears, and said synchronizing means being engaged with all of said rack gears to synchronize the rotation of the pinion gears.

9. The rolling mill of claim 1 further comprising an electric preheating device disposed between said front reel and said roll stand for preheating the metal strip to a predetermined level of electrical energy saturation.

10. The rolling mill of claim 9 wherein the electric preheating device comprises a parallelogrammic frame and at least one pair of conductor rolls supported by the frame, so that electricity is supplied directly to said conductor rolls from the electric power suppliers.

11. The rolling mill of claim 10 wherein sides of the frame are pivotally connected at intersection of any two adjacent sides so that angles between the sides may be adjusted whereby area of contact between the conductor rolls and the strip changes, one of the pair of conductor rolls being rotatably fixed by one side of the frame and the other of the pair of conductor rolls being rotatably fixed by another side of the frame.

12. The rolling mill of claim 10 wherein wherein the each of conductor rolls comprises two semi-cylindrical conductor elements being coupled by spring means for maintaining a predetermined contact pressure against each other.

13. The rolling mill of claim 9 wherein the electric power suppliers comprise a first electric power supply means for supplying electric power to the means for applying electricity to the working rolls and a second electric power supply means for supplying electricity to said preheating device.

14. The rolling mill of claim 11, wherein each of the conductor rolls comprises two semi-cylindrical conductor elements being coupled by spring means for maintaining a predetermined contact pressure against each other.

15. The rolling mill of claim 10 wherein said frame of the electric preheating device is a parallelogrammic frame.

* * * * *